US007234338B2

(12) United States Patent
Mirtz et al.

(10) Patent No.: US 7,234,338 B2
(45) Date of Patent: Jun. 26, 2007

(54) TUBING BENDER AND METHOD

(75) Inventors: Richard Arthur Mirtz, Northglenn, CO (US); Richard Keith Bergquist, Marietta, OK (US)

(73) Assignee: The Gates Corporation, Denver, CO (US)

( * ) Notice: Subject to any disclaimer, the term of this patent is extended or adjusted under 35 U.S.C. 154(b) by 0 days.

(21) Appl. No.: 11/148,664

(22) Filed: Jun. 9, 2005

(65) Prior Publication Data

US 2006/0277968 A1 Dec. 14, 2006

(51) Int. Cl.
*B21B 45/02* (2006.01)
*B21D 9/05* (2006.01)

(52) U.S. Cl. ..... 72/459; 72/388; 72/216; 72/217; 72/149

(58) Field of Classification Search ..... 72/388, 72/459, 149, 157, 159, 217, 458, 216
See application file for complete search history.

(56) References Cited

U.S. PATENT DOCUMENTS 1,899,281 A * 2/1933 Lidseen ..... 72/157
3,194,038 A * 7/1965 Small et al. ..... 72/459
3,447,353 A * 6/1969 Noveske ..... 72/217
3,789,640 A * 2/1974 Frank ..... 72/388
4,379,399 A * 4/1983 Kowal ..... 72/388
4,424,699 A * 1/1984 Peppers ..... 72/459
D334,754 S 4/1993 Pearson et al. ..... D15/123
5,220,818 A 6/1993 Hansen ..... 72/217
5,284,040 A * 2/1994 Beelen et al. ..... 72/149
5,301,530 A * 4/1994 Beelen et al. ..... 72/149
6,463,780 B1 10/2002 Kalanish ..... 72/388
6,487,889 B1 * 12/2002 Bates et al. ..... 72/459
6,609,405 B1 8/2003 Bates et al. ..... 72/459

FOREIGN PATENT DOCUMENTS

DE 596692 5/1934

* cited by examiner

*Primary Examiner*—David B. Jones
(74) *Attorney, Agent, or Firm*—J. L. Mahurin, Esq.; C. H. Castleman, Esq.; J. A. Thurnau, Esq.

(57) ABSTRACT

An improved tubing bender of the type having a mounting base, a mandrel mounted upon the mounting base and having a tube recess, and a tube retainer mounted upon the mounting base. It is improved by the tube retainer being mounted upon the mounting base by a snap-lock journal.

19 Claims, 3 Drawing Sheets

TUBING BENDER AND METHOD

BACKGROUND OF THE INVENTION

1. Field of the Invention

This invention relates to tubing benders and more particularly to tubing benders capable of effecting bends in tubing of differing diameters. Specifically, it relates to improved tubing benders with improved tubing retention and handling properties.

2. Description of the Prior Art

Electricians have used portable tubing benders to bend electrical conduit. Similarly plumbers and other craftsmen have used tubing benders to bend tubing for a variety of applications. A typical tubing bender includes a mandrel having an arcuate groove or recess. The radius of the arc of the groove roughly corresponds with the radius of bend, or bending radius, to be imposed upon the tubing. The groove is typically semicircular in cross section with a radius that generally corresponds to the outside radius of the tubing, the holding radius. The mandrel is secured to a handle while a forming press having complementary surfaces is secured to a second handle and the handles are pivotally connected together. A hook arrangement, or tube retainer, is provided to retain the tubing in appropriate orientation with the groove in the mandrel as bending is effected by relatively rotating the handles such that the forming press orbits around the mandrel groove. There have been tubing benders having mandrels with sets of arcuate grooves, or tube recesses, which have different arc radii. This allows such a tubing bender to be prepared to bend tubes to different radii without assembling a new mandrel to the remainder of the bender. An example of the foregoing can be found in U.S. Pat. No. 6,487,889, which is fully incorporated herein by this reference.

While tubing benders of this type increase the flexibility for bending tubing to different radii, they still have substantial shortcomings. They are awkward to handle both while providing the necessary bending moments and during installation of tubing to be bent. While providing the bending moments, the operator frequently feels as though another hand is needed. With one hand on each handle and the tubing placed in the bender, the entire assembly becomes unwieldy when the operator must support the bender with a length of tubing inserted therein and at the same time bring the handles together to accomplish a bend with an arc of adequate precision to make the bent tube useful. Even more significant, the placement of the tube to be bent into the bender requires holding the tube in place while holding the bender, with its tendency to bend uncontrollably about the mandrel, while concurrently coping with tricky placement of the hook arrangement about the tube and, with all hands already occupied, tightening a thumbscrew to hold the hook in place that is to hold the tube in place. This clearly is job for which a juggler may be best suited.

Thus, it is highly desirable to provide a tool for bending tubing to a range of bend radii and over a range of arcs that is less clumsy both during insertion of tubing to be bent and during actual bending of the tube, allowing a quicker and more precise bending process.

Accordingly, even though portable tubing benders have been in use for a long time, there is a continuing need for such a tubing bender.

SUMMARY OF THE INVENTION

The present invention has as an object the provision of a tubing bender with greater ease of use.

The present invention is an improved tubing bender of the type having a mounting base, a mandrel mounted upon the mounting base and having a tube recess, and a tube retainer mounted upon the mounting base. It is improved by the tube retainer being mounted upon the mounting base by a snap-lock journal.

BRIEF DESCRIPTION OF THE DRAWINGS

The accompanying drawings, which are incorporated in and form part of the specification in which like numerals designate like parts, illustrate preferred embodiments of the present invention and together with the description, serve to explain the principles of the invention. In the drawings.

DETAILED DESCRIPTION OF THE PREFERRED EMBODIMENTS

Figure 1:
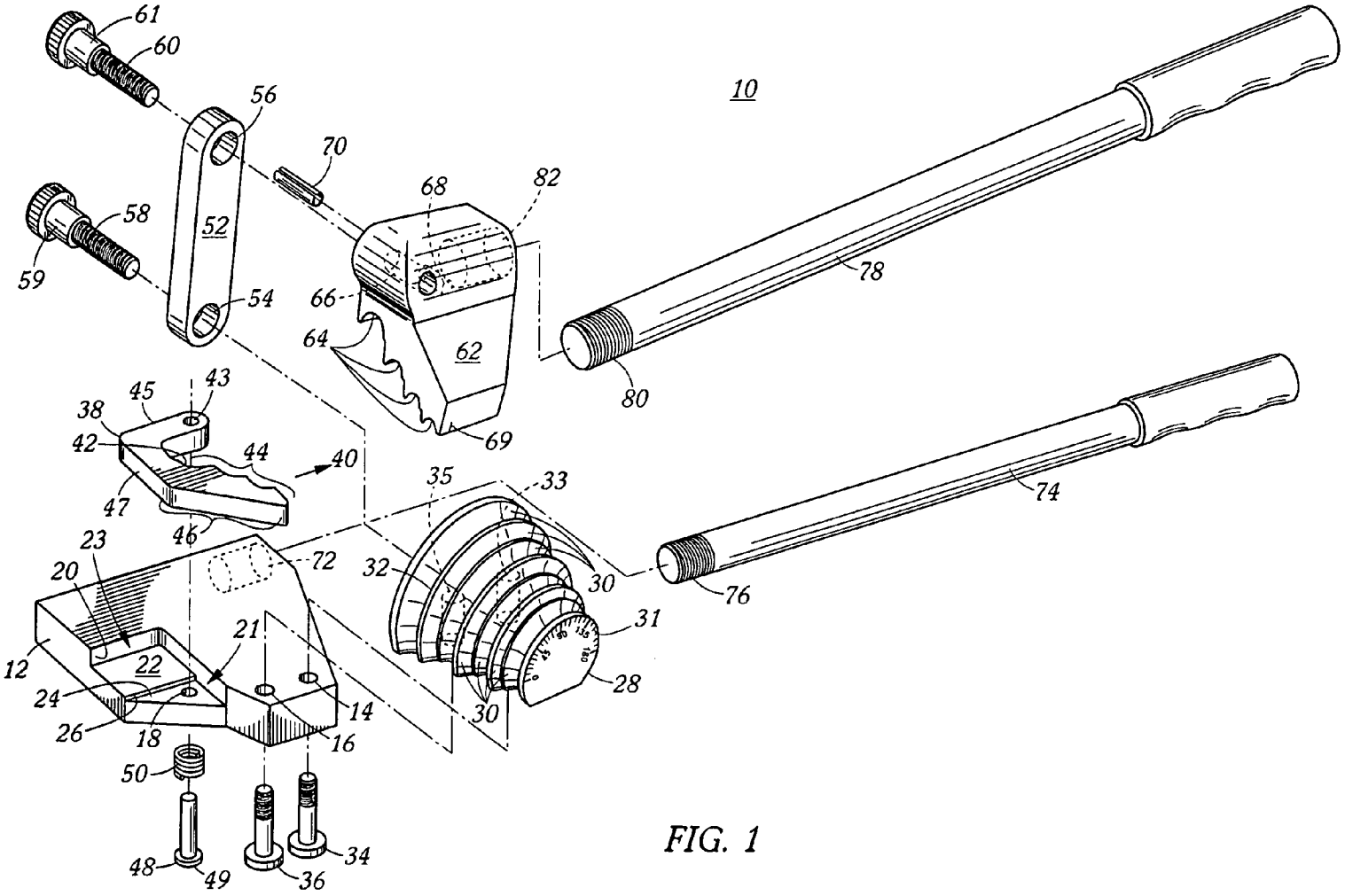
FIG. 1 is an exploded perspective of a preferred embodiment.
Figure 4:
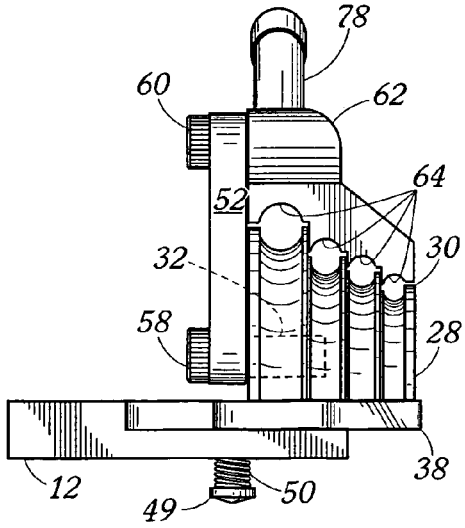
FIG. 4 is an elevation end-view of a preferred embodiment.

Referring to FIG. 1, one preferred embodiment of the tubing bender 10 is depicted. Mounting base 12 includes first mounting hole 14, second mounting hole 16, pivot hole 18, upper recess wall 20, lower recess 21, open face 22, upper recess 23, close face 24, stop abutment 26, and base handle hole 72. Mandrel 28 includes tube recesses or grooves 30, graduations 31, mandrel link bolt hole 32 located at the center of the arcs of grooves 30 (depicted in FIG. 4), first base mount hole 33 (threaded), and second base mount hole 35 (threaded). Mandrel 28 is affixed to mounting base 12 by first mandrel to base bolt 34 passing through first mounting hole 14 and threading snugly in first base mount hole 33, and second mandrel to base bolt 36 passing through second mounting hole 16 and threading snugly in second base mount hole 35.

Figure 6:
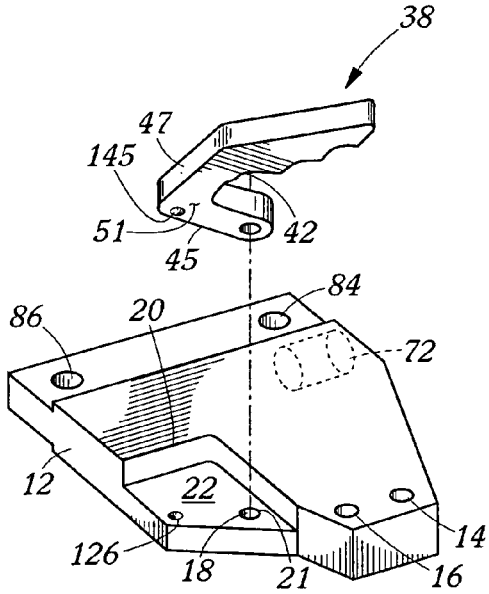

Tube retainer 38 includes retaining portion 46 comprising mandrel side 40, having compliments to grooves 30 in the form of steps 42 upon ramp 44, press fit hole 43, retainer abutment 45, open stop wall 47, and pivotal face 51 (depicted in FIG. 6). Retainer 38 is mounted upon mounting base 12 by rotation pin 48 (having pin head or button 49) passing through compression spring 50 and pivot hole 18 and press fitting within press fit hole 43. The fit between pivot hole 18 and rotation pin 48 is loose enough to allow rotation pin 48 to rotate within pivot hole 18.

The combination of stop abutment 26 and retainer abutment 45 cooperate to form a pivot stop. The combination of stop abutment 26, retainer abutment 45, pivot hole 18, compression spring 50, rotation pin 48 and button 49 form a snap-lock journal for tube retainer 38, in relation to mounting base 12. A snap-lock journal being a pivotal connection where the pivoting item can move about its pivot point, over a portion of its available range of motion, but has a point where a spring bias causes a discontinuous restriction on the available range of motion.

Figure 2:
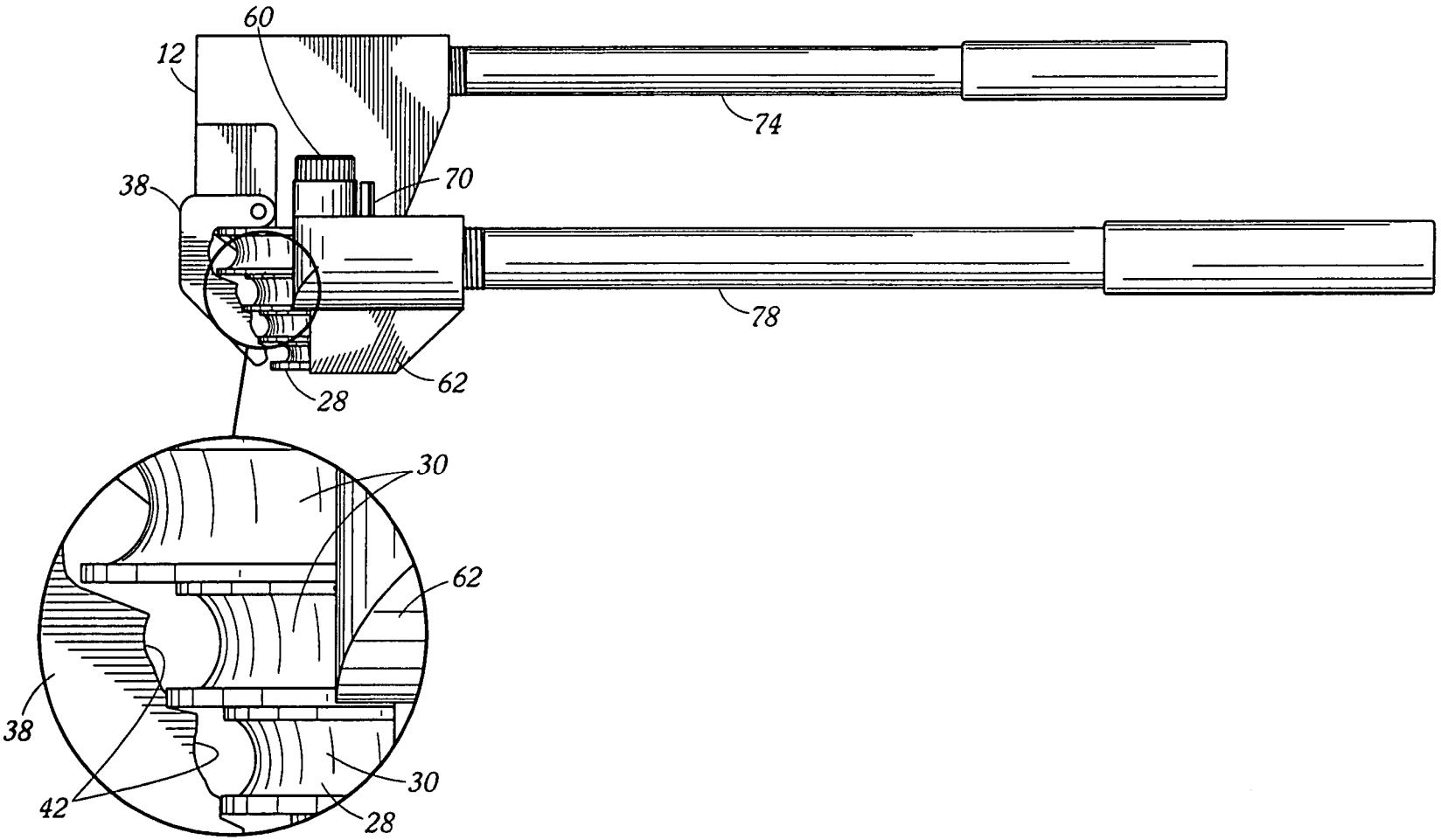
FIG. 2 is a plan view of a preferred embodiment with an enlarged portion.

When tube retainer 38 is in the position depicted in FIG. 2, it is residing in lower recess 21 resting against close face 24 because of the bias created by compression spring 50 operating upon rotation pin 48 through button 49. Retainer abutment 45 is proximate to stop abutment 26. This proximity prevents tube retainer 38 from rotating clockwise from this point.

When button 49 is depressed, tube retainer 38 lifts from close face 24. If button 49 is depressed enough, retainer 38 will sit higher than open face 22. In this condition, tube retainer 38 can be rotated clockwise about the pivot formed by pivot hole 18 and rotation pin 48 until open stop wall 47 contacts upper recess wall 20. Releasing button 49, at this point, allows the bias from compression spring 50 to pull tube retainer 38 to a resting position in upper recess 23 and against open face 22. Tube retainer 38 can be rotated counterclockwise sliding pivotal face 51 across open face 22 without depressing button 49. When retainer abutment 45 aligns with stop abutment 26, the bias provided by compression spring 50 causes tube retainer 38 to drop or snap into lower recess 21. Anytime prior to alignment of retainer abutment 45 with stop abutment 26, tube retainer 38 can be slid clockwise to the point that retainer abutment 45 is proximate to upper recess wall 20. Once tube retainer 38 drops into lower recess 21 it cannot be returned to upper recess 23 without dressing button 49.

Link 52 is pivotally mounted upon mandrel 28 with first link bolt 58. First link bolt 58 is inserted through first link hole 54 and then threaded into mandrel link bolt hole 32 until stopped by first shank 59. First shank 59 is sized to allow link 52 to pivot about first link bolt 58 with a limited amount of other movement.

Forming press 62 includes forming notches 64, press link bolt hole 66, stop pin hole 68, marker 69, and press handle hole 82. Stop pin 70 is split along its length to allow compression of its diameter. Stop pin 70 is so compressed and inserted for about half of its length into stop pin hole 68. Link 52 is pivotally mounted to forming press 62 with second link bolt 60. Second link bolt 60 is inserted through second link hole 56 and then threaded into press link bolt hole 66 until stopped by second shank 61. Second shank 61 is sized to allow second link bolt 60 and affixed mandrel 28 to pivot in relation to link 52 with a limited amount of other movement. Stop pin 70 orbits around the rounded end of link 52 and limits the total amount of pivoting allowed to mandrel 28 upon contact of stop pin 70 with the straight portions of link 52.

Assembly of tubing bender 10 is completed by threading base handle 74 via base handle threads 76 into base handle hole 72 and press handle 78 via press handle threads 80 into press handle hole 82.

In operation, button 49 is pressed to lift tube retainer 38 to be higher than open face 22. Tube retainer 38 is then rotated clockwise until open stop wall 47 abuts upper recess wall 20. Button 49 and tube retainer 38 are then left unattended such that tube retainer 38 resides in upper recess 23. Starting from the position generally depicted in FIG. 1, press handle 78 is moved away from base handle 74 to cause forming press 62 to pivot counterclockwise in relation to link 52 and link 52 to pivot counterclockwise about first link bolt 58 until forming press 62 has moved substantially away from mandrel 28 clearing an opening for vertical (parallel to first mandrel to base bolt 34) placement of the tubing to be bent against a chosen tube recess 30 ("clearance position"). The tubing to be bent (not depicted) is then vertically placed against a tube recess 30 chosen according to the diameter of the tube to be bent. Tube retainer 38 is moved counterclockwise until it snaps into place, holding the tubing to be bent against mandrel 28. Press handle 78 is then moved toward base handle 74 while watching marker 69 in relation to graduations 31. When marker 69 aligns with the amount of arc, number of degrees, to which the tubing is to be bent, movement of press handle 78 is reversed to the clearance position. Once again, button 49 is pressed to lift tube retainer 38. Tube retainer 38 is placed into upper recess 23. The bent tubing is removed from tubing bender 10. Note that placing tube retainer 38 to a position that holds the tubing to be bent requires only a single and simple movement. This eliminates the need to try to hold tubing bender 10, the tubing to be bent (tending to occupy both hands) while adjusting tubing retainer 38 to an ill-defined position, holding that position manually, and then tightening a thumbscrew.

FIG. 2 depicts an assembled tubing bender 10 in a closed position. The enlargement show a closer view of the relationship of tube recesses or grooves 30 to groove compliments 42, in this embodiment in the form of steps.

Figure 3:
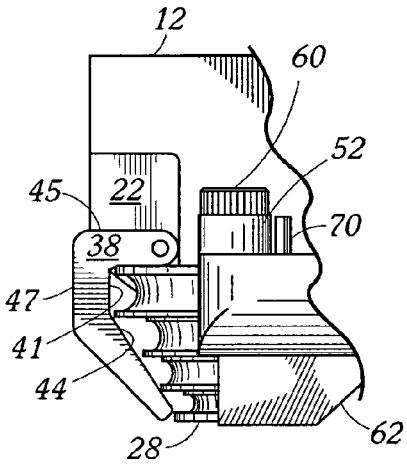
FIG. 3 is a plan view detail of a preferred embodiment.

An additional embodiment is depicted in FIG. 3. Here, groove compliments are replaced by flat 41 and ramp 44. Ramp 44 is depicted as linear. However, a curvature that more closely follows the general shape of mandrel 28 is also contemplated. This embodiment is the same as the embodiment previously described in all other respects.

FIG. 6 depicts another embodiment. Tube retainer 38 utilizes the same retaining portion 46 as described in the first described embodiment. However, the snap-lock journal is different. The snap-lock journal comprises pivot hole 18, compression spring 50, rotation pin 48 and button 49, as before. However, the function of stop abutment 26, retainer abutment 45 are performed by the interrelation of depression 126 with protrusion 145. Any arrangement where mere rotational movement of tube retainer 38 into position causes it to lock into place would result in a snap-lock journal and is contemplated. If retainer abutment 45 and stop abutment 26 were angled away from pivot hole 18, rotational movement of tube retainer 38 into position would still cause it to lock into place. However, pressing of button 49 would no longer be necessary. Rather, tube retainer 38 could be forced clockwise causing retainer abutment 45 to ride up and over stop abutment 26. The same would be true for embodiment of FIG. 6.

Figure 5:
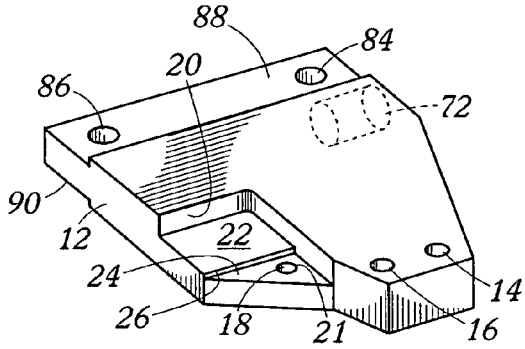
FIG. 5 is perspective view, of a mounting base, of a preferred embodiment; and, FIG. 6 is a perspective view, of a tube retainer in relation to a mounting base of a preferred embodiment.

For the embodiment depicted in FIGS. 5 and 6, mounting base 12 further includes first and second auxiliary mounting holes 84 and 86, respectively, and first and second auxiliary recesses, 88 and 90, respectively. Auxiliary holes 84 and 86 allow tubing bender 10 to be affixed to a table or bench. Auxiliary recesses 88 and 90 facilitate temporarily placing tubing bender 10 in the jaws of a vice or other clamping device. Either of these allows the operator to gain an additional hold upon tubing bender 10 to free a hand for other related activities. Embodiments with only one of either auxiliary holes 84 and 86 or auxiliary recesses 88 and 90 are also contemplated. In any of these three later described embodiments base handle hole 72 can be present or absent. If present, base handle hole 72 allows the operator the option of using tubing bender 10 mounted to a table or bench, in a vice, or with base handle 74.

The foregoing description and illustrative embodiments of the present invention have been shown on the drawings and described in detail in varying modifications and alternative embodiments. It should be understood, however, that the foregoing description of the invention is exemplary only, and that the scope of the invention is to be limited only to the claims as interpreted in view of the prior art. Moreover, the invention illustratively disclosed herein suitably may be practiced in the absence of any element which is not specifically disclosed herein.

What is claimed is:

1. An improved tubing bender of the type having a mounting base, a mandrel mounted upon said mounting base and having a tube recess, and a tube retainer mounted upon said mounting base, the improvement comprising:

said tube retainer mounted upon said mounting base by a snap-lock journal.

2. The tubing bender of claim 1 wherein said snap-lock includes a pivot operating between said tube retainer and said mounting base, a pivot stop adapted to intermittently restrain pivotal movement of said tube retainer in relation to said mounting base by a mating relationship of a stop abutment with a retainer abutment and a biasing member biasing a pivotal face of said tube retainer against a face of said mounting base.

3. The tubing bender of claim 2 wherein said pivot of includes said mating relationship of said base abutment and said retainer abutment being disengageable by pressure applied to a button.

4. The tubing bender of claim 2 wherein said pivot includes said mating relationship of said stop abutment and said retainer abutment being disengageable by pressure applied to said pivotal face.

5. The tubing bender of claim 2 wherein said stop abutment is a substantially vertical wall.

6. The tubing bender of claim 2 wherein said retainer abutment is a substantially vertical wall.

7. The tubing bender of claim 2 wherein said base abutment is a depression and said retainer abutment is a complementary depression.

8. The tubing bender of claim 7 wherein said mating relationship is disengageable upon said retainer abutment being forced over said stop abutment.

9. A tubing bender of the type having a mounting base, a mandrel mounted upon said mounting base and having a plurality of tube recesses, each of said tube recesses having a bending radius and a holding radius, and of the type having a tube retainer mounted upon said mounting base, said tubing bender further comprising:

said tube retainer having a mandrel side complementary to a plurality of said tube recesses and adapted to secure a tube therein between, said mandrel side comprising at least one step corresponding to at least one of said tube recesses.

10. A tubing bender of the type having a mounting base, a mandrel mounted upon said mounting base and having a plurality of tube recesses, each of said tube recesses having a bending radius and a holding radius, and of the type having a tube retainer mounted upon said mounting base, said tubing bender further comprising:

said tube retainer having a mandrel side complementary to a plurality of said tube recesses and adapted to secure a tube therein between, said mandrel side comprising at least one step corresponding to atl least one of said tube recesses, said step cooperating with said holding radius to form a broken irregular annulus.

11. The tubing bender of claim 9 wherein said mandrel side comprises at least one step corresponding to at least one of said tube recesses and said step cooperates with said holding radius to form a broken irregular annulus.

12. A tube retainer adapted fro use with a tubing bender of the type having a mounting base, a mandrel mounted upon said mounting base and having a plurality of tube recesses, each of said tube recesses having a bending radius and a holding radius, and of the type having a tube retainer mounted upon said mounting base, said tube retainer comprising:

a mandrel side complementary to a plurality of said tube recesses, said mandrel side comprising a ramp having a plurality of retaining portions corresponding to said tube recesses and adapted to secure a tube between each said retaining portion and said corresponding tube recess.

13. The tube retainer of claim 12 wherein said ramp is linear.

14. The tube retainer of claim 12 wherein said ramp is curved.

15. The tube retainer of claim 12 wherein said ramp comprises at least one curve.

16. A method of bending a tube comprising the steps of:

providing a mounting base, providing a mandrel having a tube recess including a bending radius and a holding radius, providing a journal having a journal axis and having a snap-lock, providing a tube retainer, mounting said mandrel upon said mounting base, joining said tube retainer and said mounting base via said journal, providing said tube, placing said tube against a portion of said tube recess in engagement with said holding radius, rotating said tube retainer about said journal axis, engaging said snap-lock, and wrapping said tube about a portion of said bending radius.

17. A method comprising:

disposing a tube to be bent in a tubing bender;

snap-locking a tube retainer in place to retain said tube to be bent in said tubing bender; and bending the tube being retained by said tube retainer using said tubing bender.

18. The method of claim 17, wherein said snap-locking further comprises:

biasing said tube retainer into engagement with an abutment defined in a base of said tubing bender.

19. The method of claim 17, wherein said snap-locking further comprises:

rotating said tubing retainer into a position that biases said tube retainer into engagement with an abutment defined in a base of said tubing bender and into engagement with said tube to be bent to retain said tube to be bent in said tubing bender.

* * * * *